US007258526B2

(12) United States Patent
Dooley et al.

(10) Patent No.: US 7,258,526 B2
(45) Date of Patent: Aug. 21, 2007

(54) EDDY CURRENT HEATING FOR REDUCING TRANSIENT THERMAL STRESSES IN A ROTOR OF A GAS TURBINE ENGINE

(75) Inventors: Kevin Allan Dooley, Mississauga (CA); Farid Abrari, Toronto (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 223 days.

(21) Appl. No.: 11/082,653

(22) Filed: Mar. 18, 2005

(65) Prior Publication Data

US 2006/0210393 A1 Sep. 21, 2006

(51) Int. Cl.
*F04D 29/04* (2006.01)

(52) U.S. Cl. ..... 416/1; 416/95; 416/244 A; 415/177

(58) Field of Classification Search ..... 416/1, 416/95, 244 A; 415/177
See application file for complete search history.

(56) References Cited

U.S. PATENT DOCUMENTS

| | | | | |
|---|---|---|---|---|
| 2,547,934 | A | | 4/1951 | Gill |
| 2,701,092 | A | | 2/1955 | Henshaw |
| 3,812,441 | A | | 5/1974 | Sakamoto et al. |
| 3,895,328 | A | | 7/1975 | Kato et al. |
| 3,903,492 | A | | 9/1975 | Endo et al. |
| 4,411,715 | A | | 10/1983 | Brisken et al. |
| 4,482,293 | A | | 11/1984 | Perry |
| 4,486,638 | A | | 12/1984 | de Bennetot |
| 4,896,756 | A | | 1/1990 | Matsushita |
| 4,897,518 | A | | 1/1990 | Mucha et al. |
| 5,397,948 | A | | 3/1995 | Zoerner et al. |
| 5,469,009 | A | | 11/1995 | Wakui et al. |
| 5,558,495 | A | * | 9/1996 | Parker et al. ..... 416/95 |
| 5,742,106 | A | | 4/1998 | Muraji |
| 5,746,580 | A | * | 5/1998 | Parker et al. ..... 416/245 R |
| 5,793,137 | A | | 8/1998 | Smith |
| 5,801,359 | A | | 9/1998 | Mano et al. |
| 5,907,202 | A | | 5/1999 | Muraji |
| 5,994,681 | A | | 11/1999 | Lloyd et al. |
| 6,144,020 | A | | 11/2000 | Usui et al. |
| 6,180,928 | B1 | | 1/2001 | Garrigus |
| 6,250,875 | B1 | | 6/2001 | Bauer et al. |
| 6,296,441 | B1 | | 10/2001 | Gozdawa |
| 6,313,560 | B1 | | 11/2001 | Dooley |
| 6,503,056 | B2 | | 1/2003 | Eccles et al. |
| 6,543,992 | B2 | | 4/2003 | Webster |
| 6,607,354 | B1 | | 8/2003 | Klapatch et al. |
| 6,630,650 | B2 | | 10/2003 | Bassill et al. |
| 6,664,705 | B2 | | 12/2003 | Dooley |
| 2004/0189108 | A1 | | 9/2004 | Dooley |

FOREIGN PATENT DOCUMENTS

| | | |
|---|---|---|
| EP | 0 836 007 A1 | 4/1998 |
| GB | 629 764 | 9/1949 |

OTHER PUBLICATIONS

International Search Report PCT/CA2006/000365, Jun. 6, 2006.

* cited by examiner

*Primary Examiner*—Igor Kershteyn
(74) *Attorney, Agent, or Firm*—Ogilvy Renault LLP

(57) ABSTRACT

The device and method are used for heating a central section of a rotor mounted for rotation in a gas turbine engine.

35 Claims, 3 Drawing Sheets

EDDY CURRENT HEATING FOR REDUCING TRANSIENT THERMAL STRESSES IN A ROTOR OF A GAS TURBINE ENGINE

TECHNICAL FIELD

The technical field of the invention relates generally to rotors in gas turbine engines, and more particularly to devices and methods for reducing transient thermal stresses therein.

BACKGROUND OF THE ART

When starting a cold gas turbine engine, the temperature increases very rapidly in the outer section of its rotors. On the other hand, the temperature of the material around the central section of these rotors increases only gradually, generally through heat conduction so that a central section will only reach its maximum operating temperature after a relatively long running time. Meanwhile, the thermal gradients inside the rotors generate thermal stresses. These transient thermal stresses require that some of the most affected regions of the rotors be designed thicker or larger. The choice of material can also be influenced by these stresses, as well as the useful life of the rotors.

Overall, it is highly desirable to obtain a reduction of the transient thermal stresses in a rotor of a gas turbine engine because such reduction would have a positive impact on the useful life and/or the physical characteristics of the rotor, such as its weight, size or shape.

SUMMARY OF THE INVENTION

Transient thermal stresses in a rotor of a gas turbine engine can be mitigated when the central section of a rotor is heated using eddy currents. These eddy currents generate heat, which then spreads outwards. This heating results in lower transient thermal stresses inside the rotor.

In one aspect, the present invention provides a device for heating a central section of a rotor with eddy currents, the rotor being mounted for rotation in a gas turbine engine, the device comprising: at least one magnetic field producing element adjacent to an electrical conductive portion on the central section of the rotor; and a support structure on which the magnetic field producing element is mounted, the support structure being configured and disposed for a relative rotation with reference to the electrical conductive portion.

In a second aspect, the present invention provides device for heating a central section of a rotor mounted for rotation in a gas turbine engine, the device comprising: means for producing a magnetic field adjacent to an electrical conductive portion on the central section of the rotor; and means for moving the magnetic field with reference to the electrical conductive portion of the rotor, thereby generating eddy currents therein and heating the central section of the rotor.

In a third aspect, the present invention provides a method of reducing transient thermal stresses in a gas turbine engine rotor having a central section, the method comprising: producing a moving magnetic field adjacent to an electrical conductive portion on the central section of the rotor; and heating the electrical conductive portion using eddy currents generated in electrical conductive portion of the rotor by the moving magnetic field.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
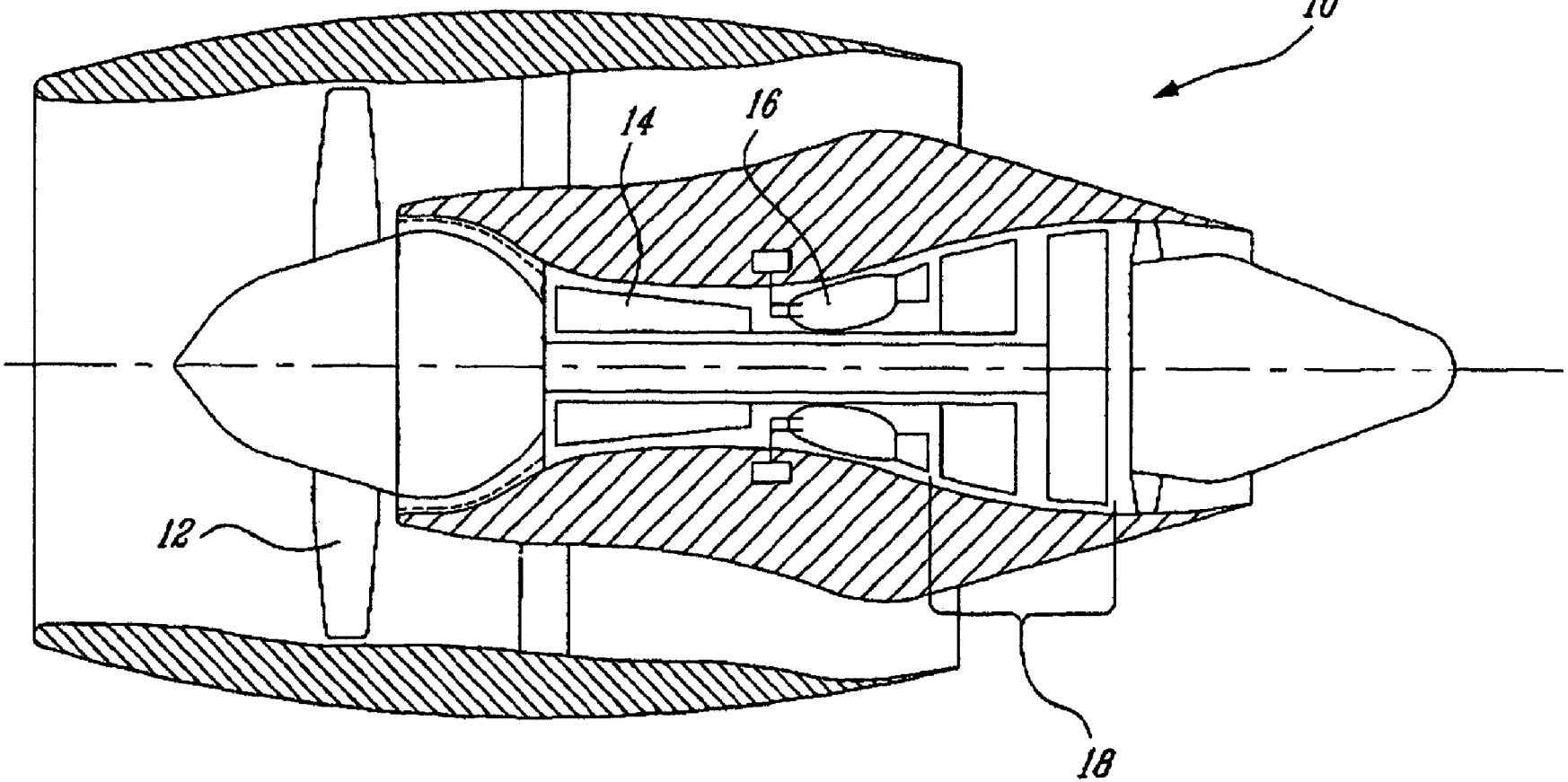
FIG. 1 schematically shows a generic gas turbine engine to illustrate an example of a general environment in which the invention can be used.

FIG. 1 schematically illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating a stream of hot combustion gases, and a turbine section 18 for extracting energy from the combustion gases. This figure only illustrates an example of the environment in which rotors can be used.

Figure 2:
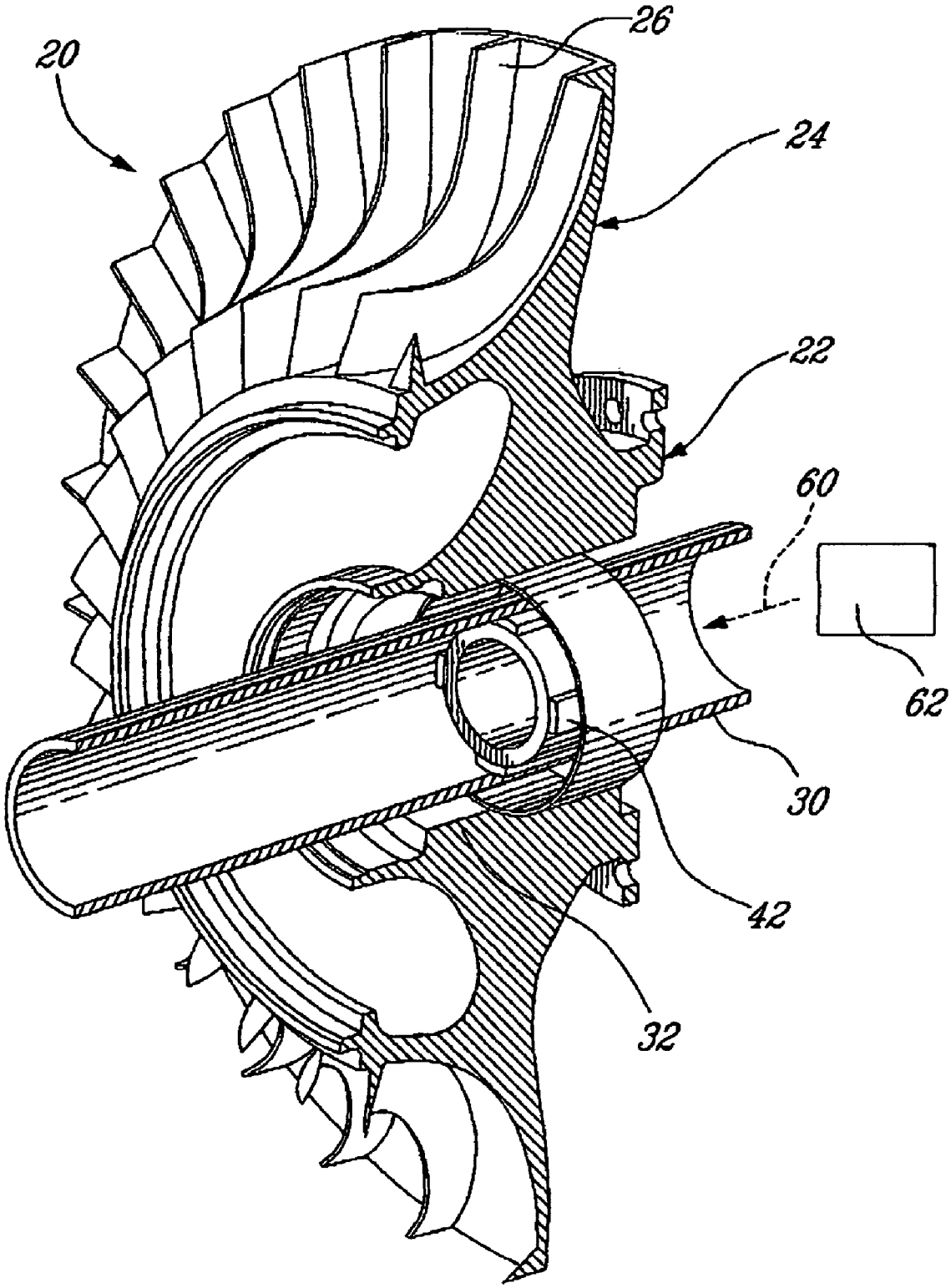
FIG. 2 is a cut-away perspective view of an example of a gas turbine engine rotor with an eddy current heater in accordance with a preferred embodiment of the present invention.

FIG. 2 semi-schematically shows an example of a gas turbine engine rotor 20, more specifically an example of an impeller used in the multistage compressor 14. The rotor 20 comprises a central section, which is generally identified with the reference numeral 22, and an outer section, which outer section is generally identified with the reference numeral 24. The outer section 24 supports a plurality of impeller blades 26. These blades 26 are used for compressing air when the rotor 20 rotates at a high rotation speed. The rotor 20 is mounted for rotation using a main shaft (not shown). In the illustrated example, the main shaft would include an interior cavity in which a second shaft, referred to as the inner shaft 30, is coaxially mounted. This configuration is typically used in gas turbine engines having a high pressure compressor and a low pressure compressor. Both shafts are mechanically independent and usually rotate at different rotation speeds. The inner shaft 30 extends through a central bore 32 provided in the central section 22 of the rotor 20.

A device, which is generally referred to with reference numeral 40, is provided for heating the central section 22 of the rotor 20 using eddy currents. Eddy currents are electrical currents induced by a moving magnetic field intersecting the surface of an electrical conductor in the central section 22. The electrical conductor is preferably provided at the surface of the central bore 32. The device 40 comprises at least one magnetic field producing element adjacent to the electrical conductive portion.

Figure 3:
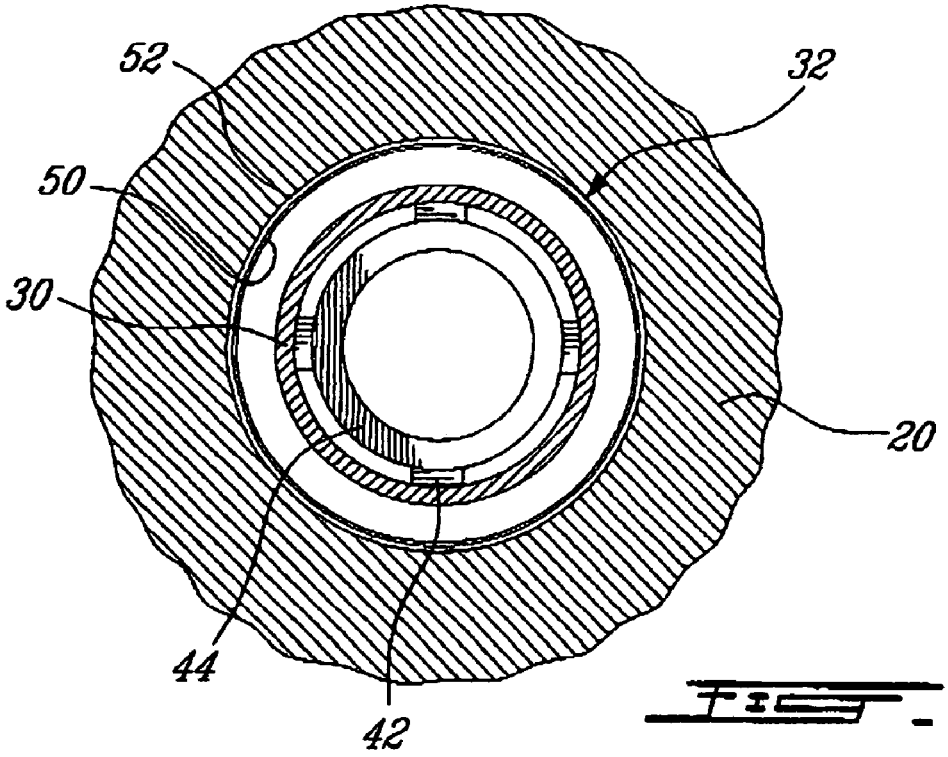
FIG. 3 is a radial cross-sectional view of the rotor and the heater shown in FIG. 2.
Figure 4:
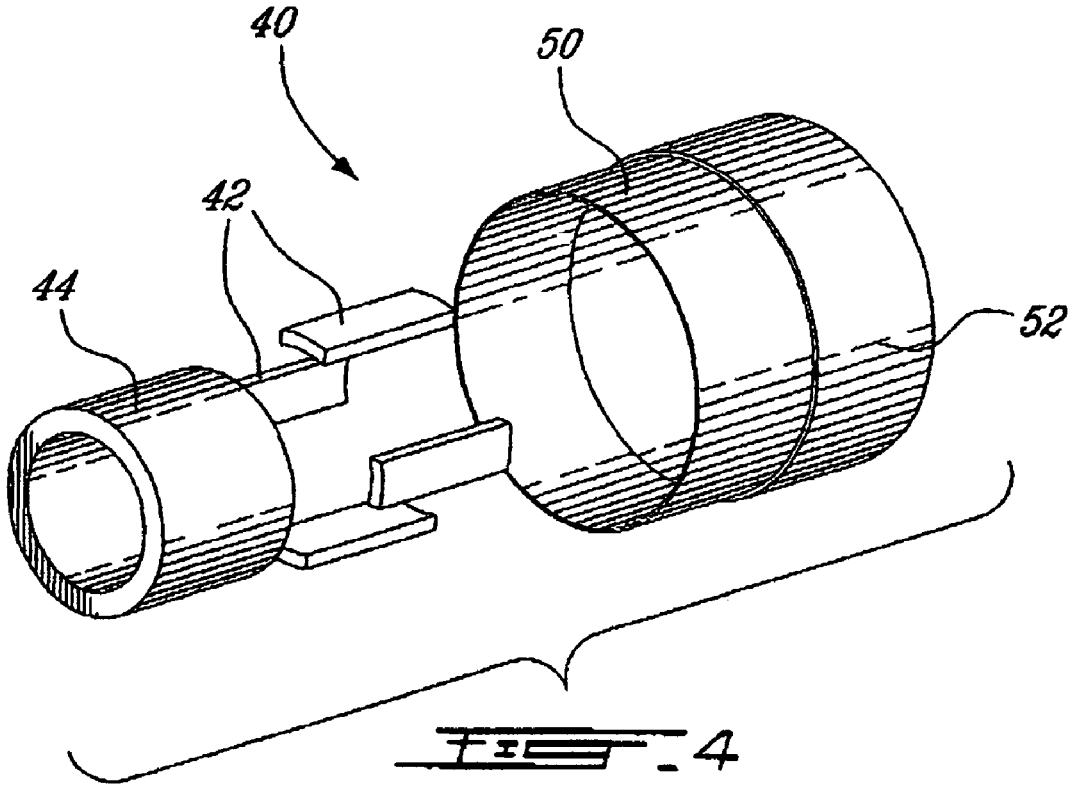
FIG. 4 is an exploded view of the heater shown in FIGS. 2 and 3.

FIGS. 2 to 4 show the device 40 being preferably provided with a set of permanent magnets 42, more preferably four of them, as the magnetic field producing elements. These magnets 42 are made, for instance, of samarium cobalt. They are mounted around a support structure 44, which is preferably set inside the inner shaft 30. Ferrite is one possible material for the support structure 44. The support structure 44 is preferably tubular and the magnets 42 are shaped to fit thereon. The magnets 42 and the support structure 44 are preferably mounted with interference inside the inner shaft 30. The position of the magnets 42 and the support structure 44 is chosen so that the magnets 42 be as close as possible to the electrical conducive portion of the rotor 20 once assembled.

Since the set of magnets 42 and the support structure 44 are mounted on the inner shaft 30, and since the inner shaft 30 generally rotates at a different speed with reference to the rotor 20, the magnets 42 create a moving magnetic field. This magnetic field will then create a magnetic circuit with the electrical conductor portion in the central section of the rotor 20, provided that the inner shaft 30 is made of a magnetically permeable material. Similarly, providing the magnets 42 on a non-moving support structure adjacent to the rotor 20 would produce a relative rotation, thus a moving magnetic field.

The electrical conductor portion of the central section 22 of the rotor 20 can be the surface of the central bore 32 itself if, for instance, the rotor 20 is made of a good electrical conductive material. If not, or if the creation of the eddy currents in the material of the rotor 20 is not optimum, a sleeve or cartridge made of a different material can be added inside the central bore 32. In the illustrated embodiment, the device 40 comprises a cartridge made of two sleeves 50, 52. The inner sleeve 50 is preferably made of copper, or any other very good electrical conductor. The outer sleeve 52, which is preferably made of steel or any material with similar properties, is provided for improving the magnetic path and holding the inner sleeve 50. The pair of sleeves 50, 52 can be mounted with interference inside the central bore 32 or be otherwise attached thereto to provide a good thermal contact between the sleeves 50, 52 and the bore to be heated.

In use, the rotor 20 of FIG. 2 is brought into rotation at a very high speed and air is compressed by the blades 26. This compression generates heat, which is transferred to the blades 26 and then to the outer section 24 of the rotor 20. At the same time, there will be a relative rotation between the rotor 20 and the inner shaft 30 since both are generally rotating at different rotation speeds. This creates the moving magnetic field in the inner sleeve 50 attached to the rotor 20, thereby inducing eddy currents therein. The material is thus heated and the heat, through conduction, is transferred to the outer sleeve 52 and to the outer section 24 itself.

As can be appreciated, heating the rotor 20 from the inside will mitigate the transient thermal stresses that are experienced during the warm-up period of the gas turbine engine 10. Since there are less stresses on the rotor 20, changes in its design are possible to make it lighter or otherwise more efficient.

As aforesaid, ferrite is one possible material for the support structure 44. Ferrite is a material which has a Curie point. When a material having a Curie point is heated above a temperature referred to as the "Curie temperature", it loses its magnetic properties. This feature is used to lower the heat generation by the device 20 once the inner section 22 of the rotor 20 reaches the maximum operating temperature. Accordingly, the support structure 44, when made of ferrite or any other material having a Curie point, can be heated to reduce the eddy currents. Preferably, heat to control the ferrite Curie point is produced using a flow of hot air 60 coming from a hotter section of the gas turbine engine 10 and directed inside the inner shaft 30. A bleed valve 62, or a similar arrangement, can be used to selectively heat the support structure 44, if desired. However, as the gas turbine engine 10 is accelerated to a take-off speed, air in the shaft area is intrinsically heated as a result of increasing the speed of the engine, and thus the support structure 44 is automatically heated and hence no valve or controls are needed. This intrinsic heating by the engine causes the eddy current heating effect to be significantly reduced as the engine 10 is accelerated to take-off. This arrangement thus preferably only heats the desired target when there is not sufficient engine hot air to do the job, such as after start-up and while warming up the engine before takeoff. Eddy current heating in this application would not be usable if the magnetic field was left fully 'on' all the time, since the heating effect is magnified as the speed is increased and heating is not required at the higher speeds. Thus, the intrinsic thermostatic feature of the present invention facilitates the heating concept presented.

The above description is meant to be exemplary only, and one skilled in the art will recognize that changes may be made to the embodiments described without departing from the scope of the invention disclosed. For example, the device can be used with different kinds of rotors than the one illustrated in the appended figures, including turbine rotors. The magnets can be provided in different numbers or with a different configuration than what is shown. The use of electro-magnets is also possible. Magnets can be mounted over the inner shaft 30, instead of inside. Any configuration which results in relative movement so as to cause eddy current heating may be used. For example, the magnets need not be on a rotating shaft. Other materials than ferrite are possible for the support structure 44. Other materials than samarium cobalt are possible for the magnets 42. Still other modifications which fall within the scope of the present invention will be apparent to those skilled in the art, in light of a review of this disclosure, and such modifications are intended to fall within the appended claims.

What is claimed is:

1. A device for heating a central section of a rotor of a gas turbine engine with eddy currents, the device comprising:

at least one magnetic field producing element adjacent to an electrical conductive portion on the central section of the rotor of the gas turbine engine; and a support structure on which the magnetic field producing element is mounted, the support structure being configured and disposed for a relative rotation with reference to the electrical conductive portion.

2. The device as defined in claim 1, wherein the magnetic field producing element includes a permanent magnet.

3. The device as defined in claim 1, wherein the electrical conductive portion comprises a sleeve made of a material having an electrical conductivity higher than that of a remainder portion of the rotor.

4. The device as defined in claim 3, wherein the sleeve is made of a material including copper.

5. The device as defined in claim 4, wherein the sleeve is connected to the remainder portion of the rotor by an outer sleeve made of a different material.

6. The device as defined in claim 5, wherein the material of the outer sleeve includes steel.

7. The device as defined in claim 1, wherein the support structure and the magnet are positioned inside a shaft independent from the rotor and coaxially positioned therewith.

8. The device as defined in claim 1, wherein the support structure is non-rotating.

9. The device as defined in claim 1, wherein the support structure is made of a material having a Curie temperature, the material being selected to have a Curie temperature associated with a desired shut-down temperature of the device.

10. The device as defined in claim 9, wherein the support structure is made of ferrite.

11. The device as defined in claim 9, further comprising means for selectively heating the support structure above its Curie temperature.

12. A device for heating a central section of a rotor of a gas turbine engine, the device comprising:

means for producing a magnetic field adjacent to an electrical conductive portion on the central section of the rotor of the gas turbine engine; and means for moving the magnetic field with reference to the electrical conductive portion of the rotor, thereby generating eddy currents therein and heating the central section of the rotor.

13. The device as defined in claim 12, wherein the means for producing a magnetic field includes a permanent magnet.

14. The device as defined in claim 12, wherein the electrical conductive portion comprises a sleeve made of a material having an electrical conductivity higher than that of a remainder portion of the rotor.

15. The device as defined in claim 14, wherein the sleeve is made of a material including copper.

16. The device as defined in claim 15, wherein the sleeve is connected to the remainder portion of the rotor by an outer sleeve made of a different material.

17. The device as defined in claim 16, wherein the material of the outer sleeve includes steel.

18. The device as defined in claim 12, wherein the means for producing a magnetic field and the means for moving the magnetic field are positioned inside a shaft independent from the rotor and coaxially positioned therewith.

19. The device as defined in claim 12, wherein the means for producing a magnetic field are mounted on a non-rotating support structure, the rotor being moved with reference to the magnetic field.

20. The device as defined in claim 12, further comprising means for providing a shut-down temperature, including a support structure made of a material having a Curie temperature selected to match the desired shut-down temperature.

21. The device as defined in claim 20, wherein the support structure is made of ferrite.

22. The device as defined in claim 20, further comprising means for selectively heating the support structure above its Curie temperature.

23. A method of reducing transient thermal stresses in a gas turbine engine rotor having a central section, the method comprising:

producing a moving magnetic field adjacent to an electrical conductive portion on the central section of the rotor; and heating the electrical conductive portion using eddy currents generated in the electrical conductive portion of the rotor by the moving magnetic field.

24. The method as defined in claim 23, wherein said heating is terminated once the engine reaches a desired temperature.

25. The method as defined in claim 24, comprising the step of directing a flow of engine air to a temperature sensing apparatus.

26. The method as defined in claim 23, wherein the step of heating occurs automatically as a result of increasing the speed of the engine upon start-up.

27. The method as defined in claim 23, wherein the step of heating is terminated before takeoff.

28. The method as defined in claim 24, wherein heating is terminated by interrupting said eddy currents.

29. The method as defined in claim 23, further comprising the steps of providing a plurality of magnets to provide said magnetic field and providing a material adjacent to the plurality of magnets for conducting said magnetic field, wherein the material has a Curie point selected to correspond to a desired maximum heating temperature, and wherein the maximum heating temperature is selected below a maximum operating temperature of the engine, and further comprising the step of using engine heat to heat the material above the Curie point to terminate the step of heating.

30. The method as defined in claim 29, wherein the desired maximum heating temperature corresponds to an engine temperature at which transient heating is no longer desired.

31. A gas turbine engine comprising:

a rotor supporting blades disposed in a gas path of the engine, the rotor mounted for rotation on a rotor shaft, the rotor having a central bore;

a heating apparatus including a plurality of permanent magnets adjacent an electrically conductive material, the electrically conductive material being on the rotor disposed around the bore, the permanent magnets inside the bore, the rotor rotatable independently of the permanent magnets to thereby induce eddy currents in the electrically conductive material when the rotor rotates;

a temperature control apparatus configured to interrupt said eddy currents while the rotor is rotating.

32. The gas turbine engine as defined in claim 31, wherein the permanent magnets are disposed on a second shaft disposed concentrically inside said rotor shaft.

33. The gas turbine engine as defined in claim 32, wherein the permanent magnets are disposed inside the second shaft.

34. The gas turbine engine as defined in claim 31, wherein the temperature control apparatus includes a material having a Curie temperature, the material for conducting magnetic flux from the permanent magnets, and wherein the engine in use has an operating temperature and the Curie temperature is less than the operating temperature.

35. The gas turbine engine as defined in claim 31, wherein the temperature control apparatus is in air flow communication with an engine air flow indicative of a temperature of the gas path.

* * * * *